United States Patent [19]

Drake

[11] Patent Number: 4,557,436

[45] Date of Patent: Dec. 10, 1985

[54] APPARATUS FOR STORING A CABLE

[75] Inventor: John A. Drake, Biggleswade, England

[73] Assignee: International Computers Limited, London, England

[21] Appl. No.: 674,512

[22] Filed: Nov. 23, 1984

[30] Foreign Application Priority Data

Dec. 14, 1983 [GB] United Kingdom ..... 8333363

[51] Int. Cl.[4] ..... B65H 75/34

[52] U.S. Cl. ..... 242/47.5

[58] Field of Search ..... 242/47.5, 129.1, 129.2; 191/12 R; 137/355.2, 355.23

[56] References Cited

U.S. PATENT DOCUMENTS

| | | | |
|---|---|---|---|
| 588,378 | 8/1897 | Bean et al. | 242/47.5 |
| 1,384,153 | 7/1921 | Roos | 242/47.5 |
| 1,468,620 | 9/1923 | Addy | 242/47.5 X |
| 1,940,701 | 12/1933 | Shope | 242/47.5 |
| 2,014,329 | 9/1935 | Hellmann | 242/47.5 |
| 2,214,759 | 9/1940 | Bosch, Jr. | 242/47.5 |
| 2,241,126 | 5/1941 | Godfrey | 242/47.5 |
| 2,837,292 | 6/1958 | Adamson | 242/47.5 |
| 3,599,887 | 8/1971 | Maverna | 242/47.5 |

*Primary Examiner*—Stanley N. Gilreath

*Attorney, Agent, or Firm*—Lee, Smith & Zickert

[57] ABSTRACT

Apparatus for storing a cable (2) in a container (4), the apparatus comprising a pair of spring tensioned pivotted arms (10), (11) mounted within the container (4) and carrying pulleys (5,6). A loop of the cable (2) is formed around the pulleys (5,6) and is expanded by the spring tension of the arms (10,11) to draw the cable (2) into the container (4). As the cable (2) is withdrawn from the container (4) the arms (10,11) move against the spring tension to allow the loop of the cable (2) to contract. A resiliently extensible portion (9) of the cable (2) is also extended during withdrawal.

3 Claims, 2 Drawing Figures

APPARATUS FOR STORING A CABLE

BACKGROUND OF THE INVENTION

The present invention relates to apparatus for storing a cable. Such apparatus may be used in conjunction with equipment which includes, for example, a test probe, light pen or similar device which is connected to the main body of the equipment by a flying lead. With this type of equipment the device at the end of the lead is often used only periodically and during such times that the device is not being used it is desirable to provide means to support or store the cable in a position in which it will not impede the operator and in which it will not be damaged.

Simple arrangements such as hooks or clips for retaining the device have previously been proposed, however, such arrangements leave the cable hanging in a loop in which state it is still liable to impede the operator and to be vulnerable to damage.

Arrangements for winding the cable onto a drum or cylinder are known. However, with such arrangements it will be realised that rotation of the drum requires that slip rings or similar devices must be employed in order to transfer signals between the cable and the main body of the equipment. When the signals are of low voltage and low current, as is often the case, slip rings are unsatisfactory because they can increase the electrical resistance in the connection between the test probe or light pen and the main body of the equipment.

It has also previously been proposed to form the cable so that it resembles a coiled spring. Such an arrangement is used, for example, to connect a telephone handset to the remainder of the instrument. However, this type of arrangement which effectively allows the cable to stretch, provides only a limited amount of extension and, when in its unstretched state, the cable is still long enough to cause problems.

An arrangement in which a flexible connecting pipe is drawn into a box or container by a spring loaded pulley has previously been proposed. In this arrangement the pipe is fixed at one point and looped around the pulley which moves along a guide rail. Thus, the loop of pipe may be drawn from the container against the spring pressure, which pressure is also effective to draw the pipe back into the container. A disadvantage with this arrangement, however, is that the pulley travel must be half the length of the required extension of the pipe which results in an unduly lengthy container.

SUMMARY OF THE INVENTION

According to the present invention, apparatus for storing a cable including; a container having a wall and an aperture therein through which the cable is retracted, the cable having an operative end remaining outside the container, a portion remote from said operative end and secured inside the container and a resiliently extensible part intermediate the remote portion and the operative end; and loop forming means within the container effective to form a loop in a portion of the cable and arranged to expand said loop; the arrangement being such that when said loop forming means expands the loop the cable is retracted into the container end when said operative end of the cable is pulled the loop forming means allows the loop to contract and the extensible part of the cable extends thereby allowing the cable to be withdrawn from the container.

BRIEF DESCRIPTION OF THE DRAWINGS

Apparatus for storing a cable attached to a light pen will now be described, by way of example, with reference to the accompanying drawing, in which.

DESCRIPTION OF THE PREFERRED EMBODIMENT

Figure 1:
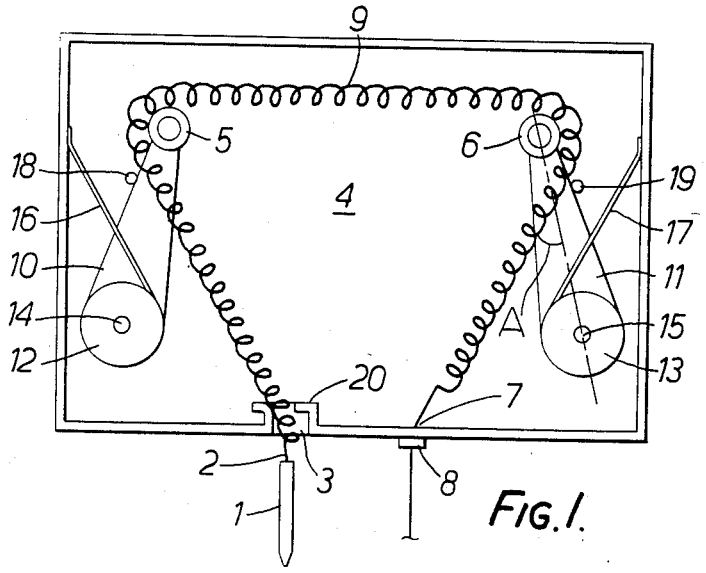
FIG. 1 is a diagramatic representation of the apparatus showing the cable in a stored condition.

Referring to FIG. 1 of the drawings, a light pen 1, which may be used in conjunction with a CRT display for example, is attached to an electrical cable 2 which enables signals to be transmitted between the light pen 1 and a control or processing device (not shown). The cable 2 is arranged to pass freely through an aperture 3 into a container 4 and passes over a pair of pulleys 5 and 6 and out of the container 4 through another aperture 7 to be connected to the control or processing device. A clamp 8 secures the cable 2 to the container 4 at the aperture 7. The cable 2 has a resiliently extensible portion 9 located approximately in the centre of the part of the cable within the container 4. The resiliently extensible portion 9 is provided by forming part of the cable 2 into a coiled spring configuration. In order to enable extension and retraction of this portion an additional wire of, for example, spring steel material, formed into a coiled spring is incorporated in the cable 2.

The pulleys 5 and 6 are rotatably mounted on arms 10 and 11 and the arms themselves are attached to cylindrical drums 12 and 13 which are rotatable about centres 14 and 15. One end of a strip of elastic material 16 is secured to the drum 12 and wrapped around its periphery in an anticlockwise direction. The other end of the strip 16 is secured to the wall of the container 4 as shown and the strip 16 is effective to cause the arm 10 to rotate in an anti-clockwise direction. Similarly, an elastic strip 17 is secured to and wrapped around the periphery of the drum 13 in a clockwise direction and attached to the wall of the container 4. Thus, the strip 17 causes the arm 11 to rotate in a clockwise direction. Stops 18 and 19 are provided to restrict the rotational movement of the arms 10 and 11 imparted by the elastic strips 16 and 17. An inward projecting lip 20 is formed at the rim of the aperture 3.

When the apparatus is in use the container 4 is secured to a bench or wall, for example, in a position adjacent the operator. The elastic strips 16 and 17 are tensioned so that the rotation imparted to the arms 10 and 11 forms the cable 2 into a loop which is effective to retract the cable into the container 4. The arms 10 and 11 will rotate until they contact their respective stops 18 and 19. The tension imparted by the elastic strips is not excessive and is arranged so that the arms 10 and 11 gently retract the cable 2 into the container 4. The tensioning of the resiliently extensible part 9 of the cable is lower than that of the arms 10 and 11 so that the arms 10 and 11 move into contact with the stops 18 and 19 before the extensible portion of the cable is fully retracted. When the cable is fully retracted into the container the light pen is supported by the cable in a position immediately adjacent the aperture 3 of the container.

When the light pen is required for use, the operator simply pulls the light pen towards its operating position. The force applied to the cable is effective to cause the extensible part of the cable to start to extend and to draw the pulleys together to cause the arms 10 and 11 to rotate against the tension imparted to them by the elastic strips 16 and 17. Thus, any desired amount of cable may be withdrawn from the container up to a maximum which is attained when the resiliently extensible portion is fully extended and the arms 10 and 11 are in the positions shown in FIG. 2.

Figure 2:
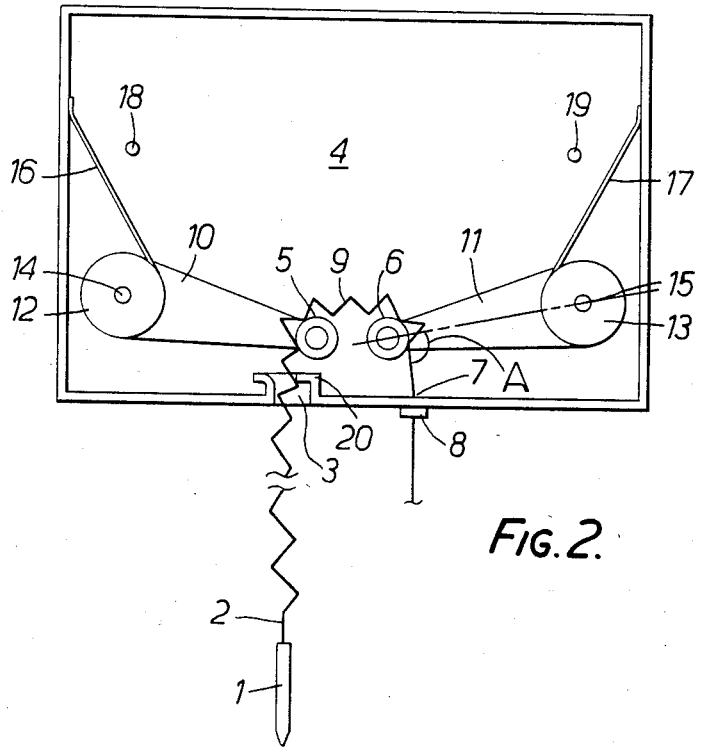
FIG. 2 shows a diagramatic representation of the apparatus with the cable extended.

It will be noted that, when the cable is fully extended the pulleys are as close as is practicable to one another and to the apertures 3 and 7. When the cable is fully retracted the arms move through approximately 90° to positions approaching the vertical to form the cable into a triangular configuration. This arrangement maximises the ratio between the cable lengths inside the container when the cable is fully retracted and when the cable is fully extended. A further advantage of this arrangement is that, regardless of the amount of cable in the container, the retraction force is almost constant to provide only a gentle pull against the operator. The reason for this is, that as the arms rotate to retract the cable, their spring tensions decrease due to contraction of the elastic strips, however, this decrease in the spring tension is compensated for by an effective reduction in the length of the arm due to a reduction in the angle A between the cable and the arms as indicated in FIGS. 1 and 2. It has also been found that this arrangement will still operate satisfactorily even though the respective tensions of the arms are not matched.

When the resiliently extensible portion is fully extended the cable is not completely straightened but tends to adopt a zig-zag configuration. This configuration effectively provides a series of notches which are engageable with the inward projecting lip 20. Thus, the operator can latch the cable at any one of a number of locations to thereby prevent its retraction. The cable is easily unlatched to allow its complete retraction into the container when required.

It will be realised that the combination of an extensible portion in the cable together with the loop forming arrangement provided by the arms 10 and 11 greatly increased the amount of cable that can be retracted into the container. Thus, the present arrangement provides advantages over previously proposed devices in that it is capable of storing a greater amount of cable into a container of relatively small dimensions.

It will be realised that the invention need not be limited in its application to electrical cables as described and that the invention is equally applicable to other types of cable, such as, for example, fibre optic cables.

I claim:

1. Apparatus for storing a cable including; a container having an aperture therein through which the cable passes, the cable having at least a part formed into a coiled configuration to render the part resiliently extensible and having an operative end remaining outside the container and a portion remote from said operative end secured inside the container; and a loop-forming arrangement within the container comprising a pair of arms pivotted at one end for independent rotation and each carrying a freely rotatable pulley at an end opposite said one end around which pulleys a loop of the cable is formed, and tensioning means for applying tension to the arms to cause them to rotate and thereby expand said loop.

2. Apparatus as claimed in claim 1 in which, as the arms rotate to expand the loop, a resultant descrease in tension applied by the tensioning means is compensated for by an effective reduction in the length of each of the arms due to a reduction in the angle between the cable and the arms to provide a substantially constant retraction force.

3. Apparatus as claimed in claim 1 in which the cable in its extended state adopts a zig-zag configuration defining a series of notches and in which said aperture includes an inward projecting lip engageable with an one of the notches to prevent retraction of the cable.

* * * * *